US005377459A

United States Patent [19]

Freiborg

[11] Patent Number: 5,377,459

[45] Date of Patent: Jan. 3, 1995

[54] RIDGE COVER AND SHINGLE AND METHOD OF MAKING AND USING THE SAME

[76] Inventor: Bennie Freiborg, 3936 Madison Rd., Flintridge, Calif. 91001

[21] Appl. No.: 99,255

[22] Filed: Jul. 29, 1993

Related U.S. Application Data

[63] Continuation of Ser. No. 682,930, Apr. 9, 1991, abandoned.

[51] Int. Cl.[6] ..... E04D 1/30; B65H 45/20

[52] U.S. Cl. ..... 52/57; 52/553; 52/560; 156/227

[58] Field of Search ..... 52/57, 518, 553, 554, 52/560; D25/141, 140; 156/204, 226, 227

[56] References Cited

U.S. PATENT DOCUMENTS

| | | | |
|---|---|---|---|
| 420,707 | 2/1890 | Toner et al. . | |
| 899,022 | 9/1908 | Benson . | |
| 1,107,568 | 8/1914 | Bamberger et al. . | |
| 1,362,755 | 12/1920 | Statler . | |
| 1,372,208 | 3/1921 | Statler . | |
| 1,410,299 | 3/1922 | Harshberger . | |
| 1,435,623 | 11/1922 | Saxe . | |
| 1,471,396 | 8/1923 | Griswold . | |
| 1,547,498 | 7/1925 | Jordan . | |
| 1,596,272 | 8/1926 | Jordan . | |
| 1,619,600 | 3/1927 | Cumfer . | |
| 1,975,986 | 10/1934 | Straub . | |
| 1,994,643 | 3/1935 | Harshberger . | |
| 2,059,233 | 11/1936 | Harshberger . | |
| 2,089,490 | 8/1937 | Kuhn . | |
| 2,110,258 | 3/1938 | Blank . | |
| 2,192,810 | 3/1940 | Angier . | |
| 2,253,753 | 8/1941 | Black . | |
| 2,305,008 | 12/1942 | Howard . | |
| 3,381,426 | 5/1968 | Heidrich | 52/57 |
| 3,913,294 | 10/1975 | Freiborg . | |
| 4,187,650 | 2/1980 | Poplin | 52/57 |
| 4,226,069 | 10/1980 | Hinds . | |
| 4,322,928 | 4/1982 | Freiborg . | |
| 4,404,783 | 9/1983 | Freiborg . | |
| 4,434,589 | 3/1984 | Freiborg . | |
| 4,439,955 | 4/1984 | Freiborg | 52/57 |
| 4,580,389 | 4/1986 | Freiborg . | |
| 4,593,512 | 6/1986 | Funaki . | |
| 4,672,790 | 6/1987 | Freiborg . | |
| 4,768,318 | 9/1988 | Freiborg . | |
| 4,803,813 | 2/1989 | Fiterman | 52/57 |
| 5,094,041 | 3/1992 | Kasner et al. | 52/57 |
| 5,094,042 | 3/1992 | Freborg | 52/57 |

FOREIGN PATENT DOCUMENTS

| | | | |
|---|---|---|---|
| 506333 | 8/1920 | France . | |
| 744271 | 7/1954 | United Kingdom | 87/1 |

*Primary Examiner*—Michael Safavi

*Attorney, Agent, or Firm*—Blakely, Sokoloff, Taylor & Zafman

[57] ABSTRACT

A ridge cover also useable as a shingle having a three dimensional appearance much like shake, together with methods of making and using the same are disclosed. In one embodiment, right isosceles triangular pieces of asphalt composition roofing material are cut. Thereafter, the material on each side of the center line bisecting the right angle is folded under the top surface of the asphalt composition material a plurality of times in a Z-fold manner along lines approximately parallel to the center line to effectively progressively thicken the material at the respective side of the center line, the folding pattern for the two sides being symmetrical with each other. In manufacture, the triangle shaped pieces may be cut from a roll of material with no waste, may be progressively folded, stacked for shipment in a substantially solid stack, easily bent over a ridge during installation, and nailed into position utilizing hidden nails to obtain double coverage on hip and ridges in a manner simulating the outline of a heavy wood shape hip and ridge cover. The symmetry of the cover makes the same also useful as a shingle for a pronounced three dimensional hidden nail double coverage installation. Alternate embodiments and methods are disclosed.

20 Claims, 3 Drawing Sheets

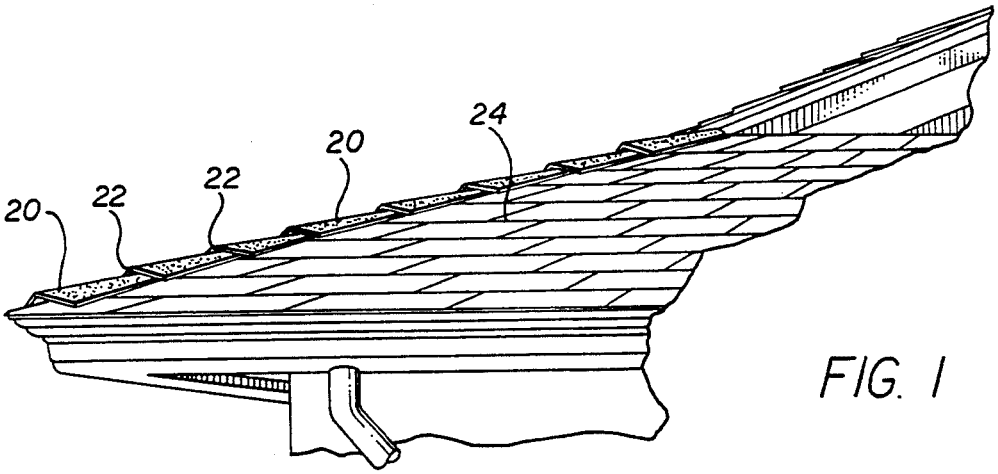
FIG. 1
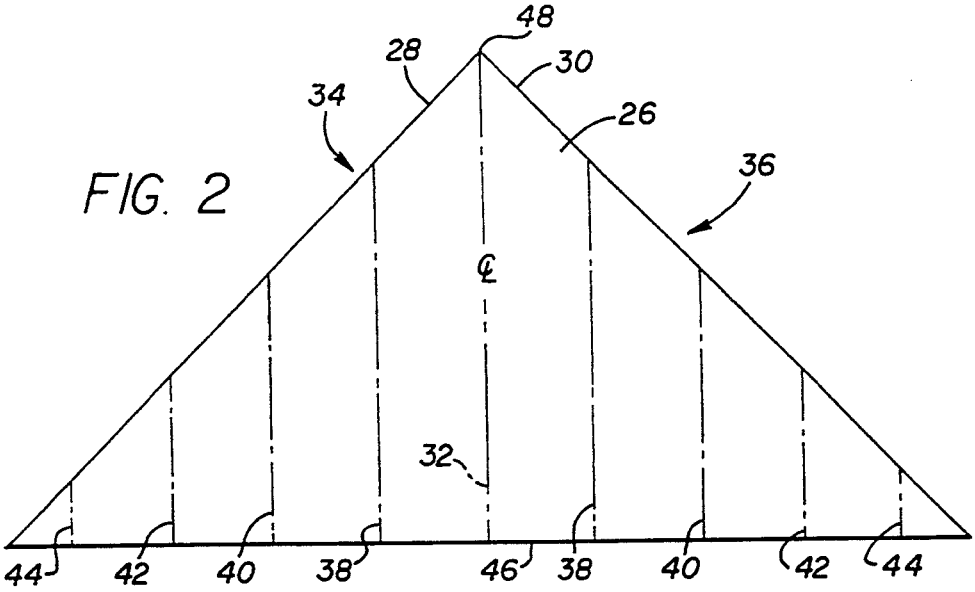
FIG. 2
FIG. 3
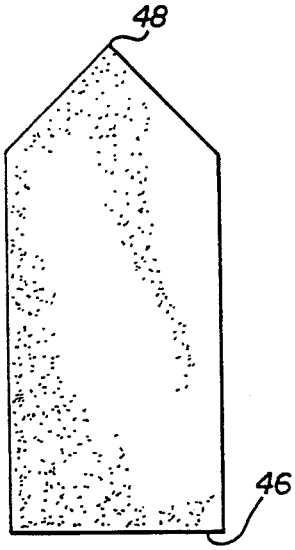
FIG. 4
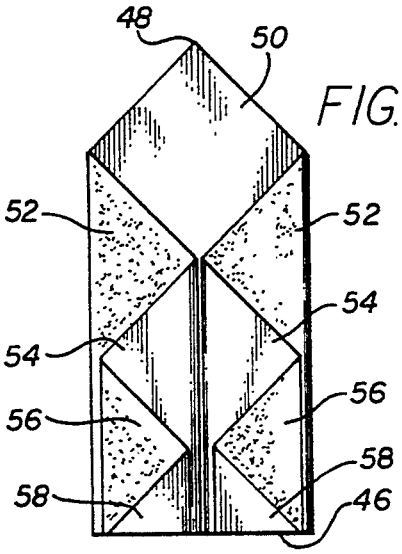

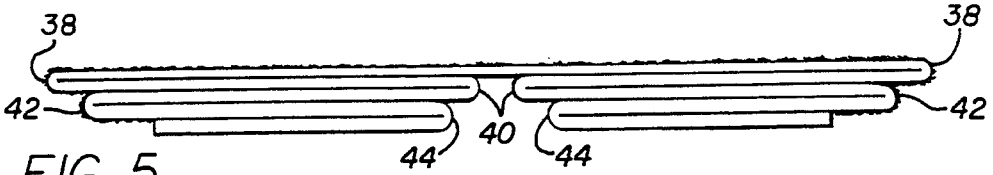
FIG. 5
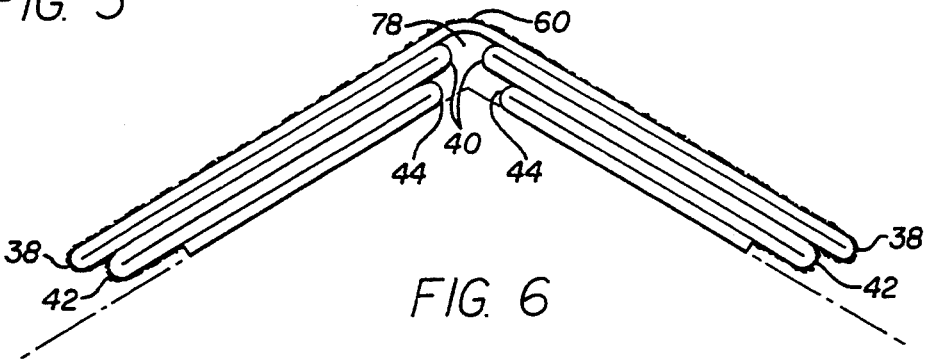
FIG. 6
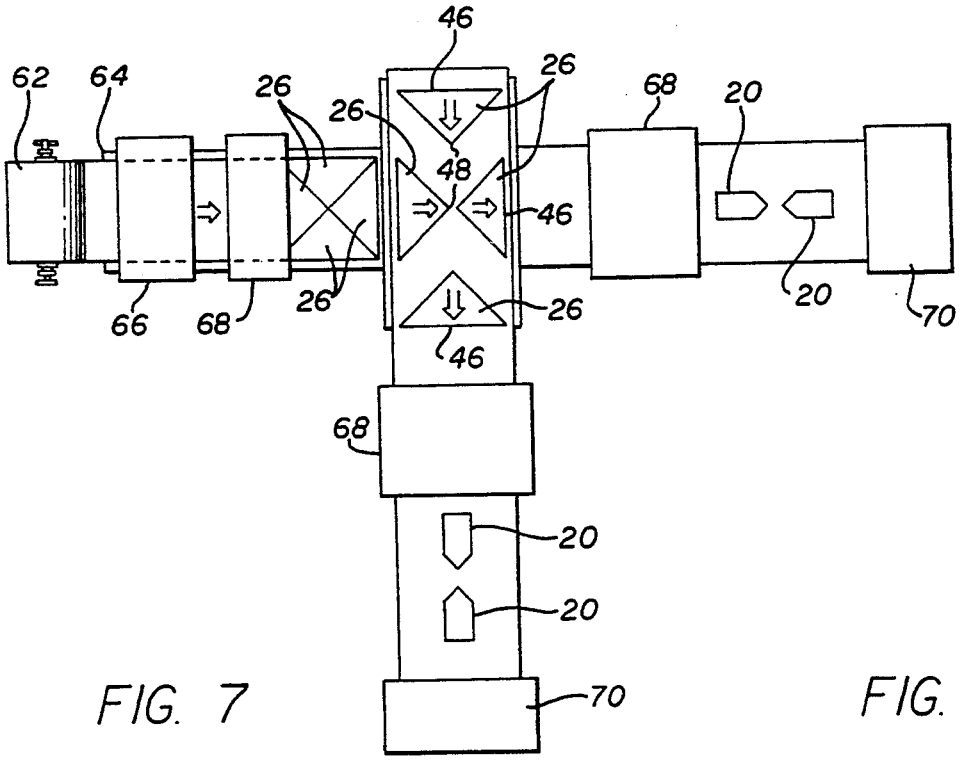
FIG. 7
FIG. 8
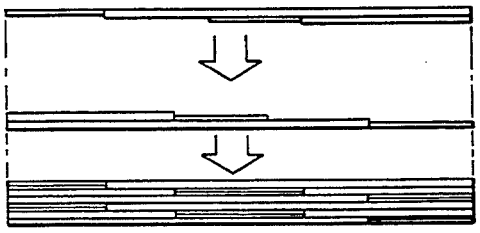

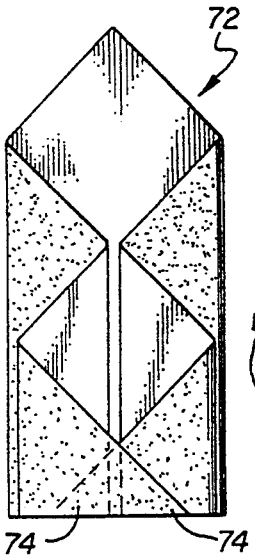
FIG. 9
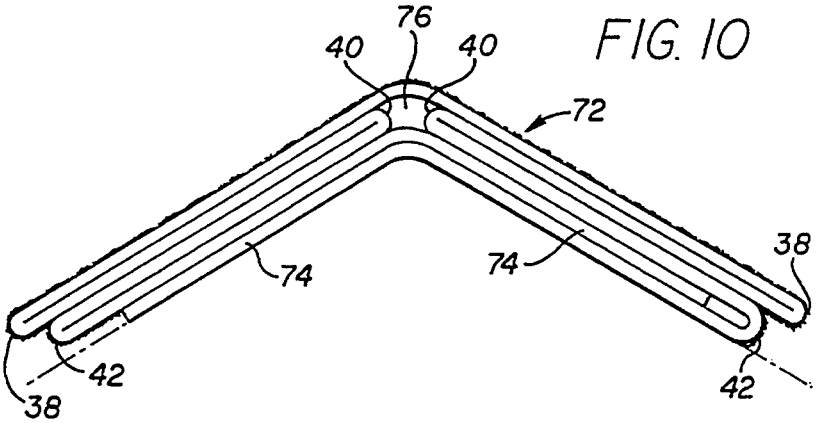
FIG. 10
FIG. 13
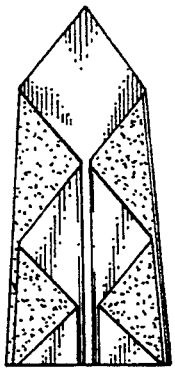
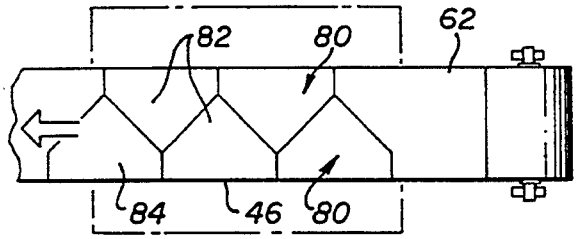
FIG. 11
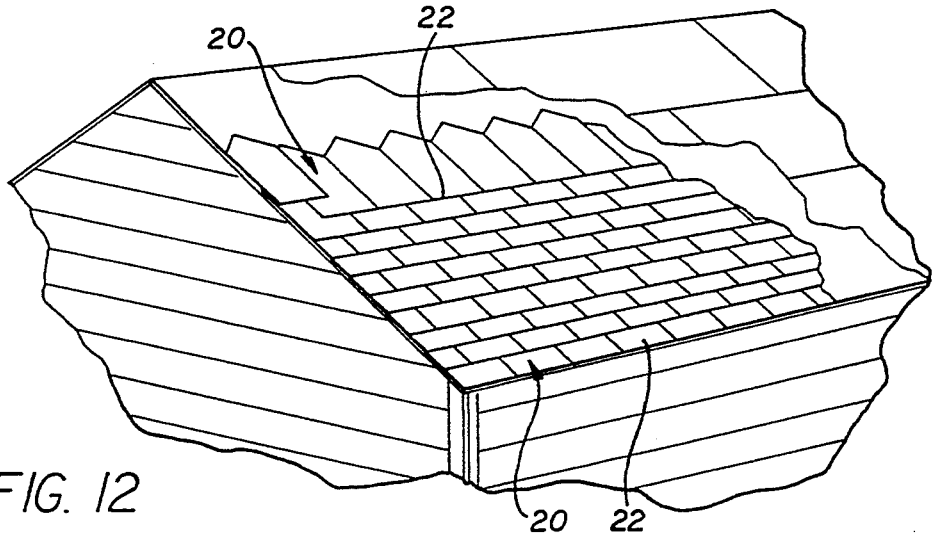
FIG. 12

RIDGE COVER AND SHINGLE AND METHOD OF MAKING AND USING THE SAME

This is a continuation/of application Ser. No. 07/682,930 filed Apr. 9, 1991 now abandoned.

BACKGROUND OF THE INVENTION

1. Field of the Invention

The present invention relates to the field of roofing, and more particularly to asphalt composition roofing.

2. Prior Art

The present invention, while useful as a shingle, is primarily intended for use as a hip and ridge cover. As such, the most relevant prior art is the inventor's U.S. Pat. No. 3,913,294. That patent discloses an asphalt composition hip and ridge cover which, on installation, will give the asphalt composition roof an outline or silhouette more resembling thick wooden shake. This in turn substantially enhances the overall appearance of an asphalt composition roof at a relatively nominal increased cost. Because of this, the ridge cover of the '294 patent has enjoyed excellent commercial success, sales thereof continually and substantially increasing each year since its introduction.

The ridge cover of the '294 patent is comprised primarily of an elongate ridge cover piece which is folded an even number of times near the center thereof to provide a thickened area in that region. Also, to allow the same to readily bend over a ridge, the upper layers in the folded region are slit along the ridge line to allow the same to spread somewhat upon folding. By installing the covers with the leading edge of one cover effectively being supported on the thickened region of the preceding ridge cover, each ridge cover appears to have a very substantial thickness like thick wood shake, dressing up an asphalt composition roof in a manner not theretofor achieved in the prior art.

As stated before, the ridge cover of the '294 patent has enjoyed excellent commercial success because of the manner in which it finishes off and dresses up an asphalt composition roof. It has certain characteristics however, which are less than ideal. By way of example, with the folded leading edge, a notch must be provided in the same so that the cover will readily fold over the roof ridge. This creates some scrap material which for substantial production volumes creates waste which is not easily disposed of. Further, the covers in accordance with the '294 patent do not stack in a good self supporting manner, very much limiting the height that packaged ridge covers may be stacked unless the packages themselves are self supporting. Accordingly, the cost of the packaging for the ridge covers in accordance with the '294 patent is substantial, as reasonable stacking height capability is required for shipment and storage purposes. Also, in a finished installation, the exposed span of the ridge piece is supported only adjacent the ends of that span, allowing the same to sag somewhat after long time exposure to the hot sun, detracting somewhat from the original appearance of the installed ridge cover over a period of time.

SUMMARY OF THE INVENTION

The present invention is a ridge cover also useable as a shingle having a three dimensional appearance much like shake, together with methods of making and using the same are disclosed. In one embodiment, right isosceles triangular pieces of asphalt composition roofing material are cut. Thereafter, the material on each side of the center line bisecting the right angle is folded under the top surface of the asphalt composition material a plurality of times in a Z-fold manner along lines approximately parallel to the center line to effectively progressively thicken the material at the respective side of the center line, the folding pattern for the two sides being symmetrical with each other. In manufacture, the triangle shaped pieces may be cut from a roll of material with no waste, may be progressively folded, stacked for shipment in a substantially solid stack, easily bent over a ridge during installation, and nailed into position utilizing hidden nails to obtain double coverage on hip and ridges in a manner simulating the outline of a heavy wood shape hip and ridge cover. The symmetry of the cover makes the same also useful as a shingle for a pronounced three dimensional hidden nail double coverage installation. Alternate embodiments and methods are disclosed.

BRIEF DESCRIPTION OF THE DRAWINGS

FIG. 1 is a perspective view of a roof with ridge covers of the present invention attached in overlapping fashion;

FIG. 2 is a bottom view of a sheet of asphalt composition cut into the shape of an equilateral triangle, showing a plurality of fold lines;

FIG. 3 is top view of the sheet of FIG. 2 folded into a ridge cover of the present design;

FIG. 4 is a bottom view of the sheet of FIG. 2 folded in a Z like fashion;

FIG. 5 is a side view of FIG. 4;

FIG. 6 is a side view of the ridge cover of FIG. 4 shown bent onto the ridge of a roof;

FIG. 7 is a diagrammatic drawing showing ridge covers being constructed from a rectangular sheet of asphalt composition;

FIG. 8 is a side view showing finished ridge covers being stacked on top of each other, wherein the thickened portion of each ridge cover is next to the thinnest portion of an adjacent ridge cover, such that the stacked covers form a solid block;

FIG. 9 is a bottom view of a ridge cover similar to the cover shown in FIG. 4, wherein the ridge cover has been folded such that the base corners of the sheet overlap into the opposite portions of the asphalt material;

FIG. 10 is a side view of the ridge cover of FIG. 9 bent onto a roof;

FIG. 11 is a top view of a sheet of asphalt composition cut into triangular shaped pieces such that the base corners of the triangles are squared;

FIG. 12 is a perspective view of a roof covered with asphalt covers of the present invention, wherein the covers are used as shingles.

FIG. 13 is a bottom view of an alternate embodiment of the ridge cover of FIG. 4, wherein the cover tapers from one end to the other.

DETAILED DESCRIPTION OF THE INVENTION

First referring to FIG. 1, a view of a portion of an asphalt composition roof with the ridge cover 20 of the present invention installed thereon may be seen. Each ridge cover has a thickened end 22, formed by appropriate folding of a piece of asphalt composition roofing material in accordance with the present invention. Each ridge cover after the first is installed over the previously installed ridge cover with the thickened end 22 thereof advanced just under ½ the length of the previously installed ridge cover and nailed in place in a region near the middle thereof, so that the next ridge cover to be installed will cover the nails securing the previous ridge cover. In this manner, the thickened ends 22 of the ridge covers 20, when used on a ridge or hip, will provide a pronounced silhouette much like the silhouette of a heavy wood shape roof, tending to accent an asphalt composition roof even if the rest of the asphalt composition roof 24 does not have a correspondingly pronounced three dimensional appearance. Thus, when installed, the ridge cover of the present invention will provide double coverage, a hidden nail installation, and a pronounced three dimensional effect similar in function and appearance to the hip and ridge cover of U.S. Pat. No. 3,913,294.

Now referring to FIG. 2, a plane view of a piece of asphalt composition material 26 prior to folding to form the ridge cover 20 of the present invention may be seen. In this embodiment, the ridge cover or blank prior to folding is in the shape of a right isosceles triangle, having a 90 degree angle between the two sides 28 and 30, which sides 28 and 30 are of equal length. Thus, the asphalt composition blank is symmetrical about the center line 32 dividing the asphalt composition blank 26 into first and second symmetrical regions 34 and 36, one on each side of the centerline 32. Also indicated in the figure are fold lines 38, 40, 42 and 44 in each of regions 34 and 36. Each pair of fold lines identified by the same numeral are symmetrical with respect to each other about the centerline 32, the fold lines, as shall subsequently be seen, representing lines not necessarily marked or defined on the blank 30, but rather at least representing lines about which folding in a particular manner will subsequently be accomplished. In a preferred embodiment, the end 46 of the triangular blank 30 is approximately 36 inches long, the width of a standard roll of asphalt composition material. Thus the length of the blank from end 46 to end 48 at the right angle junction of sides 28 and 30 is approximately 18 inches. Also in this embodiment, all of the fold lines 38, 40, 42, and 44 are parallel to the center line 32. Fold lines 38 are spaced approximately 4.25 inches from the center line 32, fold lines 40 are spaced approximately 4 inches from fold lines 38, fold lines 42 are spaced approximately 3⅝ inches from fold lines 40 and fold lines 44 are spaced approximately 3¼ inches from fold lines 42.

By making Z folds on fold lines 38, 40, 42 and 44 in each of regions 34 and 36, the portion of region 34 outside of fold line 38 in that region may be folded under the portion of region 34 between fold line 38 and centerline 32. Similarly, forming Z folds along lines 38, 40, 42 and 44 of region 36 will result in the portion of region 36 outside of fold line 38 being folded under the portion of region 36 between fold line 38 and centerline 32. The resulting ridge cover appears from the top as shown in FIG. 3, from the bottom as shown in FIG. 4, and from the end 46 as shown in FIG. 5. It may be seen from FIG. 4 that the tail portion 50 adjacent end 48 is comprised of a single thickness of asphalt composition material, regions 52 are comprised of dual thicknesses of the material, regions 54 are comprised of a total of three thicknesses of the material, regions 56 are comprised of four thicknesses of material, and finally regions 58 are comprised of five thicknesses of the asphalt composition roofing material. These five thicknesses in region 58 are also visible in FIG. 5, which shows a side view of end 46.

It will be also noted that with the position of the fold lines on the blank of FIG. 2 as hereinbefore set forth, the fold lines and thus the Z type folds fall in the positions shown in FIG. 5. In particular, the width of the ridge cover is defined by the separation between the two fold lines 38. Since fold lines 40 are closer to the respective fold lines 38 than fold lines 38 are to the centerline, the resulting folds along fold lines 40 as shown in FIG. 5 are somewhat spaced apart, with the folds along fold lines 44 being further spaced apart. Thus, when the ridge cover is folded over a ridge or hip as shown in FIG. 6, the folds adjacent the peak or hip do not interfere with each other, thereby allowing the ridge cover to be easily bent as shown in FIG. 6, yet at the same time providing good support for the center region 60 (FIG. 6) of the installed ridge cover. Also, it is to be noted that the folds along fold lines 42 are positioned somewhat inward of the folds along fold lines 38 (see FIG. 5), thereby providing the support for the asphalt composition material adjacent folds 38, though being spaced somewhat inward therefrom to provide a shadow line for the installed ridge cover. This inward stepping of the lower fold or folds from the outer edges of the ridge cover is not mandatory, though is preferred as making the exact position of the folds less critical from an aesthetic standpoint, and generating the aesthetically pleasing shadow line rather than making the lower fold or folds visible.

Now referring to FIG. 7, a schematic representation of one method of fabricating the ridge covers of the present invention may be seen. In accordance with this method, a roll of asphalt composition roofing material 62 is supported on its axis to provide material coming therefrom to a conveyor system 64. The material first passes through an infrared heater bank 66 to heat the material for easy cutting and folding. Thereafter the material passes through cutting rollers 68 which cuts the material into the triangular blanks 26 (see also FIG. 2). Because the ends 46 of each of the blanks is equal to the width of the material of roll 62, there is no scrap or waste material resulting from the cutting, with four blanks being cut from a 36 inch length of the 36 inch wide material (alternatively these dimensions may be varied for material of another width, material one meter wide also being readily commercially available). At the next position on the conveyor 64, a group of four blanks are separated from the succeeding four blanks, and from themselves, with two of the four proceeding horizontally as referenced to the plane view of FIG. 7, and two dropping to another conveyor to proceed in an octhogonal direction. In both cases, it will be noted that the two blanks 26 proceeding in each direction have opposite orientations, that is one with end 46 proceeding first, and one with end 48 proceeding first. In both cases, the blanks 26 proceed through progressive folding stations 68 which progressively and continuously force the blanks to fold about the desired fold lines as the same pass therethrough to provide the folded ridge covers 20 of this embodiment of the invention. Such progressive folding may readily be accomplished by appropriate guides and/or rollers encouraging the bending in the desired locations and forcing the same to slowly bend into the desired Z-shaped bends as they steadily move therethrough. In the preferred embodiment, adhesive is applied at or just prior to the folding station to at least one surface of each pair of surfaces which will be in contact in the folded ridge cover so that the ridge cover of FIGS. 3 through 6 is permanently cemented in the folded condition shown. This assures that the ridge cover will not become unfolded while being handled during installation, and at the same time rigidifies the forward multiple thickness portions of the ridge cover so that the same will not lift in the wind. In that regard, one could also apply an adhesive such as an asphalt adhesive under end 46 (see FIG. 4) of the ridge cover, which adhesive would adhere to the top of the ridge cover immediately thereunder upon installation. Securing the leading edge of each ridge cover to the ridge cover thereunder adjacent the region where the same is nailed in position, such adhesives are well-known in the prior art, and of course the same would avoid lifting of the leading edge of the ridge covers in the wind also. Such adhesives should not be required with the present invention however, as the cementing of the various layers of an individual ridge cover to themselves so effectively thickens and rigidifies the exposed leading edge region of the ridge covers to avoid the normal encountered lifting problem.

After the ridge covers 20 are cemented and folded, the covers proceed to packaging stations 70 where the same are stacked and packaged for shipment. As may be seen in FIG. 7, the folded ridge covers 20 alternate end to end as they come from the folding stations 68, thus they may be directly stacked as shown in FIG. 8 to provide a substantially solid vertical and self supporting stack so that the same may be stacked to substantially any height desired for shipment. In general, the ridge covers are preferably packaged so that individual packages may be readily handled by one man, such as by way of example, packaged in an amount suitable for a 30 foot ridge coverage. The important aspect of the stacking is the fact that when so packaged, the product itself is self-supporting, allowing the stacking of additional packages thereon to a reasonable height without concern for the product. Thus, the ridge covers of the present invention may be packaged simply by wrapping and banding or alternatively, by stacking in simple non self-supporting boxes. This is to be compared to the prior art of the '294 patent wherein stacking was only accomplished by using boxes having spaces sufficient to support the boxes of ridge covers thereabove, so that the ridge covers in the lower boxes were not subjected to the weight of the boxes of ridge covers stacked thereover. Thus, the present invention grossly reduces the packing costs while at the same time providing greater stacking capabilities. Further, the covers of the present invention may be packages in plastic if desired, a low cost packaging which would allow at least temporary storage outdoors without requiring any separate waterproof covering.

Now referring to FIGS. 9 and 10, an alternate embodiment of the ridge cover may be seen. FIG. 9 is a figure similar to FIG. 4 showing the bottom thereof after folding. The ridge cover 72 of this embodiment is fabricated from the same blank as the ridge cover of FIG. 4, namely the blank of FIG. 2. As before, the blank is folded about lines 38, 40 and 42, though the outer most folds about lines 44 are not made. Accordingly outer most regions 74 (see FIGS. 2, 9 and 10) extend across the center line of the ridge covers so as to overlap each other. In this embodiment, the various layers resulting from the folding along lines 38 and 40 may still be cemented together, though the triangular tabs outside of fold lines 42 (reference to FIG. 2) are left uncemented so that region 74 may readily slide over each other when the ridge cover is bent over the ridge as shown in FIG. 10. In essence, the ridge cover of FIGS. 9 and 10 functions in the same manner as that of the earlier figures though this embodiment has the advantage of resulting in a smaller space 76 at the ridge peak than the space 78 of the earlier embodiment.

FIG. 11 shows an alternate embodiment of the piece of asphalt shown in FIG. 4. In this embodiment pieces 80 are cut from a rectangular stock sheet 62, such that the pieces 80 have a triangular top portion 82 and a rectangular base 84. The pieces 80 are similar to those described above except the base corners of the triangle have been squared. When the pieces 80 are folded, they produce a cover that is thinner than the triangular pieces 26, because there is one less fold (i.e., there is no corner that is folded). The absence of the corners also produces a folded cover that has a more uniform and defined edge 46, whereas the folded portions 58 of the above described embodiment could stick out. Because of the irregular shape, the ridge covers of this embodiment are longer than the covers constructed from the triangular piece of FIG. 4. It should be noted, that the embodiment shown in FIG. 11 again produces no waste when the pieces are cut from the stock sheet.

Although a cover has been described that is installed on the ridge of a roof, it is to be understood that the covers 20 can also be used as shingle as shown in FIG. 12. The covers 20 are preferably installed such that approximately two-thirds of an underlying cover is covered by an overlapping cover. The covers being installed as hereinbefore described and in a staggered manner, wherein the thickened portion 22 of each cover is exposed such that the covers produce a roof that appears to have thick wood shake. When the covers are used as shingle, the covers may be folded to have a taper as shown in FIG. 13, such that the final product is wider toward the end 46 than end 48. Such a tapered cover does not have corners that can extend out from beneath an overlapping shingle cover, improving the overall look of the shingled roof.

What is claimed is:

1. A roof piece comprising a sheet of asphalt composition roofing material having a first end, a first side edge, a second side edge which intersect at a point that is located opposite from said first end, said point together with said first and second side edges defines at least a portion of an equilateral triangle, said sheet of asphalt composition roofing material being substantially symmetrical about a centerline from said point to said first end, thereby defining first and second regions, one on each side of said centerline, said first region being folded along a first line approximately parallel to said centerline so that part of said first region lies under an adjacent part of said first region to create a folded first region and thereby effectively thickening said first region, said second region being folded along a second line also approximately parallel to said centerline and substantially symmetrical to said first line so that part of said second region lies under an adjacent part of said second region to create a folded second region and thereby effectively thickening said second region.

2. The roof piece of claim 1 wherein a part of said first region includes a first corner where said first end and said first side edge intersect, wherein said first corner of the said folded first region lies under an adjacent part of said first region, and wherein a part of said second region includes a second corner where said first end and said second side edge intersect, wherein said second corner of said folded second region lies under an adjacent part of said second region.

3. The roof piece of claim 1 wherein a part of said first region includes a first corner where said first end and said first side edge intersect, wherein said first corner of said folded first region lies under a part of said second region, and wherein a part of said second region includes a second corner where said first end and said second side edge intersect; wherein said second corner of said folded second region lies under a part of said first region.

4. The roof piece of claim 1 wherein said first region is folded a plurality of times in a "Z" like manner along a plurality of lines including said first line approximately parallel to said centerline and along one or more lines under the part of said first region between said centerline and said first line so that multiple layers of part of said first region adjacent said first end lie under an adjacent part of said first region between said centerline and said first line, thereby effectively thickening said first region adjacent said first end between said centerline and said first line, and said second region is folded a plurality of times in a "Z" like manner along a plurality of lines including said second line approximately parallel to said centerline and along one or more lines under the part of said first region between said centerline and said second line in a manner substantially symmetrical with the folds in said first region so that multiple layers of part of said second region adjacent said first end lie under an adjacent part of said second region between said centerline and said second line, thereby effectively thickening said second region adjacent said first end between said centerline and said first line in a manner similar to the thickening of said first region adjacent said first end between said centerline and said first line.

5. The roof piece of claim 4 wherein the multiple layers of said first region are cemented together and wherein the multiple layers of said second region are cemented together.

6. The roof piece of claim 4 wherein the fold lines in said first region adjacent said centerline are spaced from said centerline and the fold lines in said second region adjacent said centerline are spaced from said centerline by amounts sufficient to allow the bending of the roof piece over a roof ridge along the centerline thereof without the folded portions interfering with each other.

7. A roof piece comprising a sheet of asphalt composition roofing material substantially in the form of a right equilateral triangle having as the base a first end, and first and second sides joining at a second end opposite said first end, said sheet of asphalt composition roofing material having first and second regions, one on each side of a centerline perpendicular to said first end, said first region being folded along a first line approximately parallel to said centerline so that part of said first region adjacent said first end lies under an adjacent part of said first region to create a folded first region, thereby effectively thickening said first region adjacent said first end between said centerline and said first line, said second region being folded along a second line also approximately parallel to said centerline and substantially symmetrical to said first line so that part of said second region adjacent said first end lies under an adjacent part of said second region to create a folded second region, thereby effectively thickening said second region adjacent said first end between said centerline and said second line.

8. The roof piece of claim 7 wherein a part of said first region includes a first corner where said first end and said first side edge intersect, wherein said first corner of the said folded first region lies under an adjacent part of said first region, and wherein a part of said second region includes a second corner where said first end and said second side edge intersect, wherein said second corner of said folded second region lies under an adjacent part of said second region.

9. The roof piece of claim 7 wherein a part of said first regimen includes a first corner where said first end and said first side edge intersect, wherein said first corner of said folded first region lies under a part of said second region, and wherein a part of said second region includes a second corner where said first end and said second side edge intersect, wherein said second corner of said folded second region lies under a part of said first region.

10. The roof piece of claim 7 wherein said first region is folded a plurality of times in a "Z" like manner along a plurality of lines including said first line approximately parallel to said centerline and along one or more lines under the part of said first region between said centerline and said first line so that multiple layers of part of said first region adjacent said first end lie under an adjacent part of said first region between said centerline and said first line, thereby effectively thickening said first region adjacent said first end between said centerline and said first line, and said second region is folded a plurality of times in a "Z" like manner along a plurality of lines including said second line approximately parallel to said centerline and along one or more lines under the part of said first region between said centerline and said second line in a manner substantially symmetrical with the folds in said first region so that multiple layers of part of said second region adjacent said first end lie under an adjacent part of said second region between said centerline and said second line, thereby effectively thickening said second region adjacent said first end between said centerline and said first line in a manner similar to the thickening of said first region adjacent said first end between said centerline and said first line.

11. The roof piece of claim 10 wherein the multiple layers of said first region are cemented together and wherein the multiple layers of said second region are cemented together.

12. The roof piece of claim 10 wherein the fold lines in said first region adjacent said centerline are spaced from said centerline and the fold lines in said second region adjacent said centerline are spaced from said centerline by amounts sufficient to allow the bending of the roof piece over a roof ridge along the center line thereof without the folded portions interfering with each other.

13. A method of forming a roof piece, comprising the steps of:

providing;

a sheet of asphalt composition roofing material having a first end, a first side edge and a second side edge which intersect at a point to define at least a portion of an equilateral triangle, said sheet of asphalt composition roofing material being substantially symmetrical about a centerline from said point said first end, thereby defining first and second regions, one on each side of said centerline;

folding said first region along a first line approximately parallel to said centerline so that part of said first region adjacent said first end lies under an adjacent part of said first region to create a folded first region, thereby effectively thickening said first region adjacent said first end between said centerline and said first line; and, folding said second region along a second line also approximately parallel to said centerline and substantially symmetrical to said first line so that part of said second region adjacent said first end lies under an adjacent part of said second region to create a folded second region, thereby effectively thickening said second region adjacent said first end between said centerline and said second line.

14. The method of claim 13 further comprising the steps of folding said first region a plurality of times in a "Z" like manner along a plurality of lines including said first line approximately parallel to said centerline and along one or more lines under the part of said first region between said centerline and said first line so that multiple layers of part of said first region adjacent said first end lie under an adjacent part of said first region between said centerline and said first line, thereby effectively thickening said first region adjacent said first end between said centerline and said first line, and folding said second region a plurality of times in a "Z" like manner along a plurality of lines including said second line approximately parallel to said centerline and along one or more lines under the part of said first region between said centerline and said second line in a manner substantially symmetrical with the folds in said first region so that multiple layers of part of said second region adjacent said first end lie under an adjacent part of said second region between said centerline and said second line, thereby effectively thickening said second region adjacent said first end between said centerline and said first line in a manner similar to the thickening of said first region adjacent said first end between said centerline and said first line.

15. The method of claim 14 wherein a part of said first region includes a first corner where said first end and said first side edge intersect, wherein said first corner of the said folded first region lies under an adjacent part of said first region, and a part of said second region includes a second corner where said first end and said second side edge intersect, wherein said corner of said folded second region lies under an adjacent part of said second region.

16. The method of claim 14 wherein a part of said first region includes first a corner where said first end and said first side edge intersect, wherein said first corner of said folded first region lies under a part of said second region, and a part of said second region includes a second corner where said first end and said second side edge intersect; wherein said second corner of said folded second region lies under a part of said first region.

17. The method of claim 14 wherein the multiple layers of said first region are cemented together and wherein the multiple layers of said second region are cemented together.

18. The method of claim 14 wherein the fold lines in said first region adjacent said centerline are spaced from said centerline and the fold lines in said second region adjacent said centerline are spaced from said centerline by amounts sufficient to allow the bending of the roof piece over a roof ridge along the center line thereof without the folded portions interfering with each other.

19. The method of claim 13 wherein said sheet of asphalt composition roofing material is shaped as an equilateral triangle.

20. The method of claim 15 wherein said sheet of asphalt composition roofing material is shaped as an equilateral triangle.

* * * * *